US012134024B2

(12) United States Patent
Lloyd

(10) Patent No.: US 12,134,024 B2
(45) Date of Patent: Nov. 5, 2024

(54) ROTATABLE SNOWBOARD BINDING INTERFACE

(71) Applicant: Frederick Lloyd, Phoenix, AZ (US)

(72) Inventor: Frederick Lloyd, Phoenix, AZ (US)

( * ) Notice: Subject to any disclaimer, the term of this patent is extended or adjusted under 35 U.S.C. 154(b) by 0 days.

(21) Appl. No.: 18/084,408

(22) Filed: Dec. 19, 2022

(65) Prior Publication Data

US 2024/0198205 A1 Jun. 20, 2024

(51) Int. Cl.
*A63C 10/18* (2012.01)

(52) U.S. Cl.
CPC ..... *A63C 10/18* (2013.01)

(58) Field of Classification Search
CPC ..... A63C 10/18
See application file for complete search history.

(56) References Cited

U.S. PATENT DOCUMENTS 5,791,678 A * 8/1998 Perlman ..... A63C 10/14 280/617
5,890,729 A 4/1999 Bayer et al.
5,897,128 A * 4/1999 McKenzie ..... A63C 10/14 280/607
5,941,555 A * 8/1999 Dodge ..... A63C 10/103 280/623
6,065,767 A * 5/2000 Girotto ..... A63C 10/103 280/14.22
6,916,036 B1 * 7/2005 Egli ..... A63C 10/18 280/14.22
7,090,228 B2 8/2006 Reynolds
9,004,503 B2 4/2015 Sorenson
2003/0164599 A1 * 9/2003 Golling ..... A63C 10/02 280/611
2003/0230870 A1 * 12/2003 Sabol ..... A63C 10/14 280/618
2010/0109289 A1 * 5/2010 Wischhusen ..... A63C 10/145 280/613
2010/0171277 A1 * 7/2010 Hwongbo ..... A63C 10/14 280/14.24
2015/0202523 A1 * 7/2015 Deutsch ..... A63C 5/06 280/618
2015/0238843 A1 * 8/2015 Allenspach ..... A63C 10/18 280/613
2016/0346665 A1 * 12/2016 West ..... A63C 10/24
2018/0078845 A1 * 3/2018 Mohler ..... A63C 5/0417

* cited by examiner

*Primary Examiner* — Brian L Swenson
(74) *Attorney, Agent, or Firm* — George D. Morgan

(57) ABSTRACT

A rotatable binding interface for a snowboard for facilitating usage of the snowboard in at least two different orientations is disclosed herein. The rotatable binding interface includes a fixed assembly that is coupled to a snowboard body. A rotatable assembly is coupled to the fixed assembly, wherein the rotatable assembly is configured to allow fitment of a binding thereon, wherein a user may rotate the rotatable assembly using a foot placed in the binding by applying a twisting motion drive to the rotatable assembly. The rotatable assembly is configured to be locked in at least two different orientations for the user. The rotatable binding interface further includes a locking assembly configured to lock the rotatable assembly in at least two different orientations. There is a hinged binding interface that can tilt up when the rotatable assembly is rotated to an orientation where the user's boot is parallel to the length of the snowboard.

17 Claims, 19 Drawing Sheets

ROTATABLE SNOWBOARD BINDING INTERFACE

TECHNICAL FIELD

The present disclosure relates to snowboards in general. In particular, the present disclosure relates to a binding interface for a snowboard that facilitates the usage of the snowboard in at least two different orientations.

BACKGROUND

Snowboards are ridden standing sideways relative to the forward direction and orientation of the board. However, there are times when the snowboarder needs to traverse a distance that has no slope to it. This may be in or approaching the lift line, mounting the lift, or perhaps traversing the mountain from one groomed slope to another on a mostly horizontal snow-covered road. Typically, for these walking situations, the snowboarder will remove his or her trailing foot from the snowboard and walk with the leading foot still attached. Although this is the usual way to walk around, it can be quite clumsy and inconvenient.

Furthermore, while waiting in a lift line, one has an opportunity for talking with friends. Generally, people organize in the lift line two or three abreast. With a usual snowboard setup, the rider's leading foot is still attached to the board at an angle mostly orthogonal to the length of the board. If the rider is in a lift line with friends, communication is difficult because the riders will not naturally face each other. They will be talking to the back of each other, or they will attempt to twist their bodies around to catch a glimpse of each other's expressions.

Another important activity that is encountered during a normal day of snowboarding is mounting and riding the ski lift. This can be an awkward event with the addition of needing to coordinate how a mix of snowboarders and skiers will mount a lift at the same time. For example, with a typical snowboarder with a normal (left foot leading) stance riding the lift the board will hang with the longer section hanging from the left leg, angled mostly to the right. If the person on the right is a skier or a goofy rider, this may present a problem of equipment clanging together as the lift swings and sways its way to the top of the mountain.

Also, as the snowboarder is seated and riding the chairlift, the complete board, along with the empty binding, will be hanging from one leg. As mentioned, the longer heavier section hangs to one side. This produces an uneven twisting force on the knee. This often causes knee soreness during each ride up the mountain and the soreness accumulates during the day.

SUMMARY

The present disclosure envisages a rotatable binding interface for a snowboard for facilitating the usage of the snowboard in at least two different orientations. The rotatable binding interface includes a fixed assembly that is coupled to the snowboard body. A rotatable assembly is coupled to the fixed assembly, wherein the rotatable assembly is configured to allow fitment of a binding thereon, wherein a user may rotate the rotatable assembly using a boot placed in the binding by applying a twisting motion drive to the rotatable assembly. The rotatable assembly is configured to be selectively locked at one of at least two different orientations for the user, and a locking assembly locks the rotatable assembly in at least two different orientations.

When the rotatable assembly is positioned to where the boot is pointed along the long axis of the board, the heel of the boot is now "unlocked" and can be available to hinge upward at the force applied by the walking snowboarder.

DETAILED DESCRIPTION OF EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

As mentioned previously, to walk towards the lift line or traverse another non-sloped surface a user typically removes one foot from the snowboard while keeping the other foot firmly connected thereto still locked in the "riding angle". It was envisaged that changing the orientation of the user's foot while such walking will make it very convenient for a user to walk while keeping one foot attached to the snowboard. To this end, the present disclosure envisages a snowboard that may be operated by the user in at least two different orientations. As used in the present disclosure, the term orientation refers to the orientation of the user with respect to the snowboard. The snowboard envisaged in the present disclosure allows the user to rotate one of the bindings such that the length of the user's foot is in line with the length of the snowboard. The typical orientation of the user's foot in the bindings of the conventional snowboard is at an angle orthogonal to the length of the snowboard, which causes discomfort and awkwardness while walking with the snowboard attached to one foot. When the orientation of the user's foot is in line with the length of the snowboard, as opposed to being at an angle or orthogonal to the length of the snowboard, walking with a snowboard attached to one leg is much easier and more convenient. Further, if the heel of the attached foot is allowed some motion upward as the user takes a step forward with the free foot, the step can be somewhat longer and more natural, and less awkward.

Figure 1:
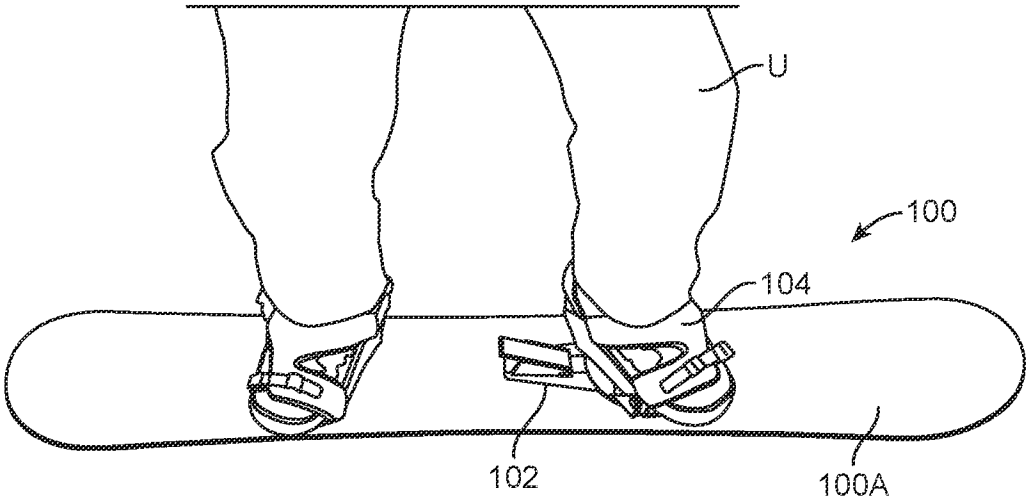
FIG. 1 and FIG. 2 show perspective views of two exemplary orientations of a snowboard, according to a first embodiment of the present disclosure.
Figure 2:
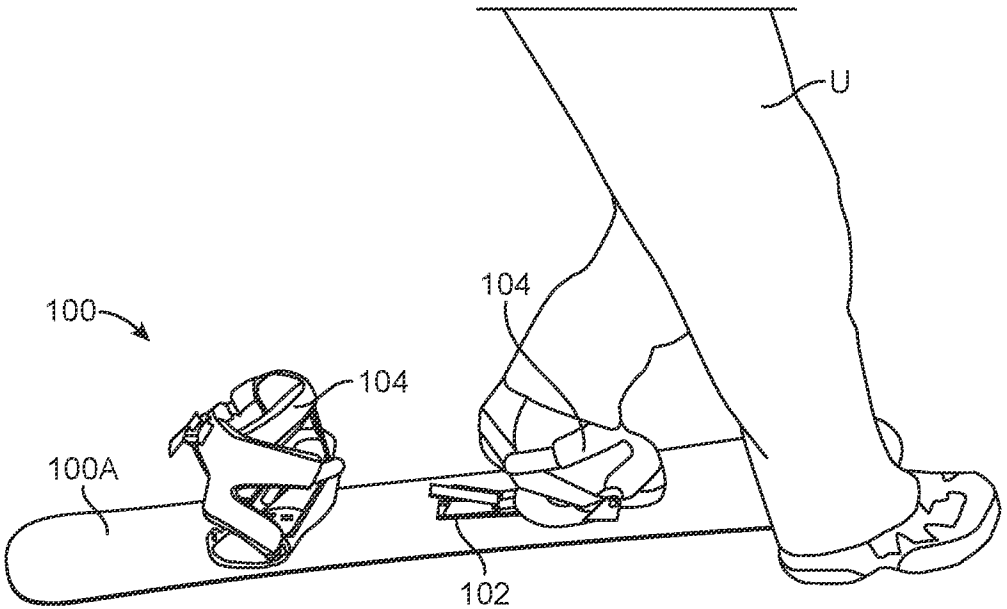

Referring to FIG. 1 and FIG. 2, perspective views of two exemplary orientations of a snowboard 100, according to a first embodiment of the present disclosure, are illustrated. The snowboard 100, in accordance with an embodiment of the present disclosure, comprises a rotatable binding interface 102 on which a snowboard binding 104 is installed. As seen in FIG. 1, the user U is using the snowboard 100 in a first orientation, wherein the first orientation is the orientation in which the foot of the user is at an angle or may even be orthogonal to the length of the snowboard 100. This first orientation may be interchangeably referred to as the riding orientation hereinafter in the present disclosure. As seen in FIG. 2, the user U is using the snowboard 100 in a second orientation, wherein the second orientation is the orientation in which the foot of the user is substantially in line with the length of the snowboard 100, which makes it relatively easier for the user to walk while having the snowboard 100 attached to one of the user's legs. This second orientation may be interchangeably referred to as the walking/skating orientation hereinafter in the present disclosure.

Figure 3:
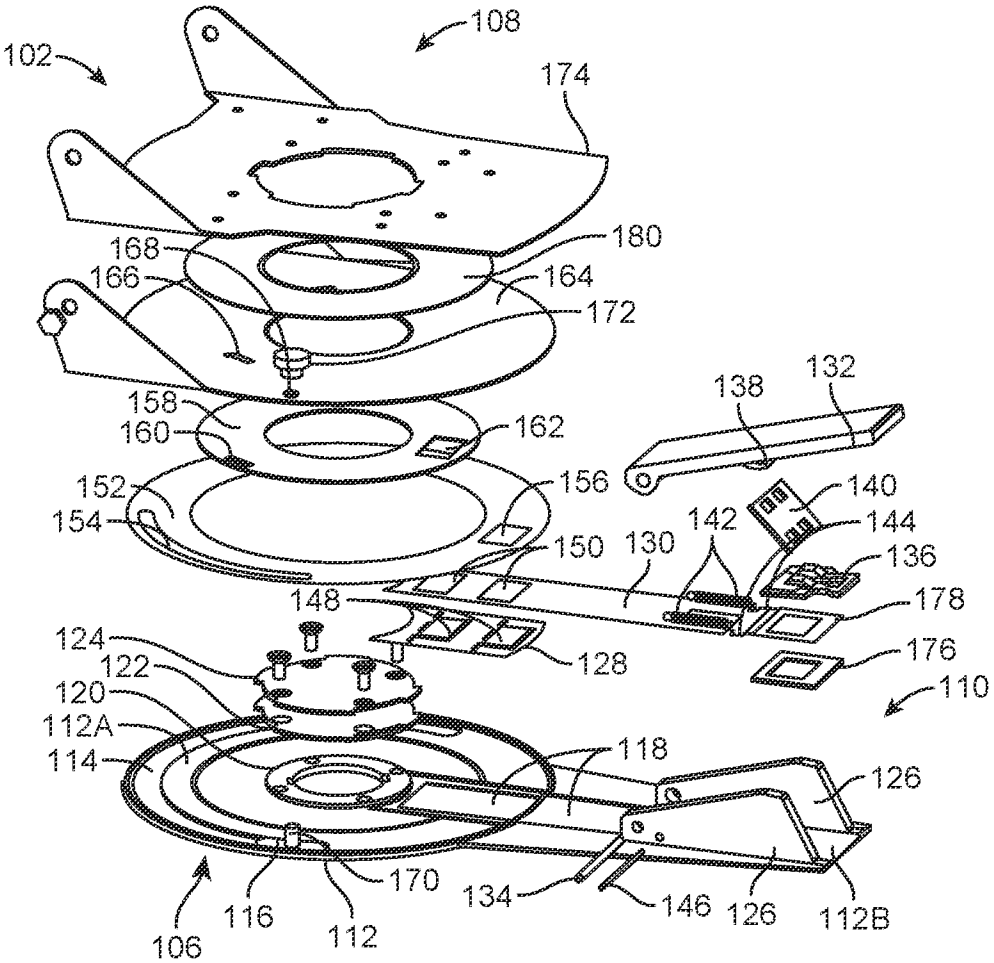
FIG. 3 shows an exploded view of the rotatable binding interface, according to the first embodiment of the present disclosure.

Referring to FIG. 3, an exploded view of the rotatable binding interface 102, according to the first embodiment of the present disclosure, is illustrated. The rotatable binding interface 102 comprises a fixed assembly 106 coupled to a snowboard body 100A of the snowboard 100. A rotatable assembly 108 is coupled to the fixed assembly 106, wherein the rotatable assembly 108 is configured to allow fitment of the snowboard binding 104 thereon. More specifically, a user may rotate the rotatable assembly 108 using a boot placed in the snowboard binding 104 by applying a twisting motion drive to the rotatable assembly 108 via the snowboard binding 104. The rotatable assembly 108 is configured to be locked in at least two different orientations for the user, viz., 20) the walking/skating orientation and the riding orientation. The rotatable binding interface 102 further comprises a locking assembly 110 securely disposed on fixed assembly 106 and configured to lock the rotatable assembly 108 in at least two different orientations.

The fixed assembly 106 comprises a main base 112 securely disposed on the snowboard body 100A. In accordance with one embodiment, the main base 112 may be fastened to the snowboard body using conventional snowboard binding bolts. The main base 112 is defined by a rotatable assembly receiving section 112A and a locking assembly receiving section 112B. In accordance with one embodiment, the rotatable assembly receiving section 112A may have a circular configuration, and the locking assembly receiving section 112B may have a trapezoidal configuration extending from the rotatable assembly receiving section 112A. It is to be noted that, however, the rotatable assembly receiving section 112A and the locking assembly receiving section 112B may have any other shapes as well, and the aforementioned shapes thereof are only exemplary.

The rotatable assembly receiving section 112A includes a first slot 114 configured on the rotatable assembly receiving section 112A for movably accommodating a knob holding base 116 therein. The first slot 114 extends along a periphery of the rotatable assembly receiving section 112A. As such, the knob holding base 116 may also be moved along the periphery of the rotatable assembly receiving section 112A. The knob holding base 116 acts as a rotational stop when it hits the end of the first slot 114. This adds to the stability and prevents over-rotation.

The main base 112 further comprises a base recess 118 configured on the main base 112 for accommodating at least one component of the locking assembly 110 therein. The base recess 118 is formed and extends on the rotatable assembly receiving section 112A and the locking assembly receiving section 112B of the main base 112. The base recess 118 is configured to accommodate the locking assembly 110 therein so that the locking assembly 110 becomes substantially coplanar with the main base 112.

The fixed assembly 106 further comprises a main rotation post 120 securely disposed substantially centrally on the main base 112. A hold-down plate 122 is securely disposed on top of the main rotation post 120. A cog plate 124 is securely disposed on top of the hold-down plate, wherein the cog plate 124 includes locking formations formed on a periphery thereof. The use and significance of the main rotation post 120, the hold-down plate 122, and the cog plate 124 are explained in the subsequent sections of the present disclosure.

The locking assembly 110 comprises a pair of protective walls 126 configured on each side of the locking assembly receiving section 112B of the main base 112. A locking tab plate 128 is securely disposed in the portion of the base recess 118 formed on the rotatable assembly receiving section 112A of the main base 112. A lock defeat slider 130 is securely held in the portion of the base recess 118 formed on the locking assembly receiving section 112B and configured to slide and interface with the locking tab plate 128 for selectively facilitating locking and unlocking of the rotatable assembly 108 in at least two different orientations. A foot lever 132 is hinged to the protective walls 126 via a hinge rod 134 and coupled to the lock defeat slider 130 for facilitating the sliding movement of the lock defeat slider 130 after the actuation of the foot lever 132 by the user.

The operation of the lock defeat slider 130 is now described. The locking assembly 110 further comprises a lower pushrod attachment formation 136 configured at a distal end of the lock defeat slider 130. An upper pushrod attachment formation 138 is configured at the bottom surface of the foot lever 132. A push rod 140 is attachable between the lower pushrod attachment formation 136 and the upper pushrod attachment formation 138. As the foot lever, 132 is pressed by the user's foot, the downward acting motion drive from the user's foot is converted to linear reciprocating motion drive of the lock defeat slider 130 due to the presence of the push rod 140 placed between the foot lever 132 and the lock defeat slider 130. As the lock defeat slider 130 is moved forward, it breaks the engagement of the locking tabs of the locking tab plate 128 with the relevant components of the rotatable assembly for then facilitating the rotation of the rotatable assembly 108 to vary the orientation of the binding. In some embodiments, to reduce friction and wear, a pad 176 may be provided between a raised end 178 of the lock defeat slider 130 and the slot 112B.

The locking tab plate 128 comprises at least two spaced-apart locking tabs 148, wherein the locking tab 148 is a cutout protrusion extending from the body of the locking tab plate 128. The locking tab 148 has a curved profile that protrudes up from the plane of the locking tab plate 128. The lock defeat slider 130 includes at least two spaced-apart tab windows 150 configured to align with and receive therein the at least two spaced-apart locking tabs 148 when the lock defeat slider is in the unactuated at-rest position. The lock defeat slider 130 is configured to slide over the at least two spaced-apart locking tabs 148 after the actuation of the foot lever 132 to push the at least two spaced-apart locking tabs 148 into the plane of locking tab plate 128 to disable the locking of the rotatable assembly 108 as long as the foot lever 132 is in a pressed actuated position. A more in-depth and elaborate discussion regarding the locking and unlocking of the rotatable assembly 108 follows in the subsequent sections of the present disclosure.

To bring the lock defeat slider 130 back in its at-rest un-actuated position, at least one biasing member 142 is installed between a pair of spring attachment tabs 144 extending from the lock defeat slider 130 and a spring holder rod 146 fitted between the pair of protective walls 126. The at least one biasing member 142 is configured to facilitate the return of the lock defeat slider 130 to an un-actuated at rest position after the removal of the user's foot from the foot lever 132.

The rotatable assembly 108, in accordance with an embodiment of the present disclosure, comprises a riding position lock ring 152 configured to be securely disposed on the rotatable assembly receiving section 112A of the main base 112. The riding position lock ring 152 includes a second slot 154 configured to align with the first slot 114 subsequent to the placement of the riding position lock ring 152 on top of the rotatable assembly receiving section 112A of the main base 112. A lock bolt is configured to pass through the second slot 154 and be received in the knob holding base 116 that is movable along the first slot 114. In an embodiment, the bolt is fixed in the knob holding base and passes through the slot 154, through-hole 168, and a finger knob or even a cam tightening knob is screwed on that bolt from the top. The riding position lock ring 152 includes a riding position lock window 156 configured thereon. The riding position lock window 156 is configured to interface with one of the at least two spaced-apart locking tabs 148, wherein the locking tab 148 is configured to fit into the riding position lock window 156 when the riding position lock ring 152 is rotated and the riding position lock window 156 passes over the locking tab 148. More specifically, when the locking tab plate 128 is placed in the base recess 118 formed on the main base 112, the locking tab plate 128 is substantially coplanar with the main base 112. As such, when the riding position lock ring 152 is disposed over the rotatable assembly receiving section 112A of the main base 112, the riding position lock ring 152 is also placed over the locking tab plate 128 for interfacing with the locking tabs 148 to facilitate the selective locking and unlocking of the riding position lock ring 152.

A walking/skating position lock ring 158 is disposed adjacent to an inner periphery of the riding position lock ring 152 such that the walking/skating position lock ring 158 and the riding position lock ring 152 are substantially coplanar. The walking/skating position lock ring 158 includes a plurality of slots 160 configured thereon.

Similar to the riding position lock ring 152, the walking/skating position lock ring 158 includes a walking/skating position lock window 162 configured thereon. The walking/skating position lock window 162 is configured to interface with the remaining one of the at least two spaced-apart locking tabs 148, wherein the locking tab 148 is configured to fit into the walking/skating position lock window 162 when the walking/skating position lock ring 158 is rotated and the walking/skating position lock window 162 passes over the locking tab 148.

The rotatable assembly further comprises a rotating base plate 164 securely disposed on top of the walking/skating position lock ring 158. The rotating base plate 164 including a plurality of protrusions 166 configured for being received within the plurality of slots 160 for transmitting the rotary motion drive from the rotating base plate 164 to the walking/skating position lock ring 158.

The rotating base plate 164 also includes a hole 168 for facilitating a fitment of the lock bolt 170 with a knob 172, wherein the lock bolt 170 extends from the knob holding base 116 and passes through the second slot 154 to be received within the hole 168. The rotation of the rotating base plate 164 is transferred to the riding position lock ring 152 via the lock bolt 170. More specifically, the lock bolt is permanently fixed in the base plate 164 (to keep alignment with the slot 154 and the hole 168). The base plate 116 and bolt 170 are one part and slide freely in the slot 114 on base 112. The knob 172 or a cam knob screws onto the top of the lock bolt 170.

The rotatable assembly 108 further comprises a hinged binding interface 174 hingeably coupled to the rotating base plate 164 and configured to receive the snowboard binding 104 thereon. The twisting rotary movement of the foot is transferred from the hinged binding interface 174 to the walking/skating position lock ring 158 and the riding position lock ring 152 via the rotating base plate 164.

The operative configuration of the snowboard 100 and the rotatable binding interface 102 is hereinafter described with reference to FIG. 1 through FIG. 3. To operate the rotatable binding interface 102 for changing the orientation of the snowboard binding 104 from walking/skating orientation to riding orientation or vice versa, first and foremost the user inserts his foot in the snowboard binding 104 that is coupled to the hinged binding interface 174 of the rotatable assembly 108. After the insertion of one user's foot in the snowboard binding 104, the user is required to press the foot lever 132 with another foot. As soon as the foot lever 132 is pressed, the lock defeat slider 130 is moved away from the central post 120. As the lock defeat slider 130 is moved away from the central post 120, the at least two spaced-apart tab windows 150 are also displaced. As the at least two spaced-apart tab windows 150 move away from the central post 120, the locking tabs 148 are disengaged from the at least two spaced-apart tab windows 150, and the locking tabs 148 are pressed downwards due to the body of the lock defeat slider 130 pressing the protruded portion of the locking tabs 148 down into the plane of the locking tab plate 128. When locking tabs 148 are pressed down by the lock defeat slider 130, a barrier in the form of the lock defeat slider 130 presents itself between the locking tabs 148 and the riding position lock window 156, and the walking/skating position lock window 162. More specifically, the barrier formed by the lock defeat slider 130 between the locking tabs 148 and the riding position lock window 156 and the walking/skating position lock window 162 forces the riding position lock ring 152 and the walking/skating position lock ring 158 out of engagement with the locking tabs 148. As such, the walking/skating position lock ring 158 and the riding position lock ring 152 are free to rotate under the influence of the twisting force applied by the user on the snowboard binding 104, which in turn is coupled to the hinged binding interface 174.

The rotation of the hinged binding interface 174 is then transmitted to the rotating base plate 164. The walking/skating position lock ring 158 is connected to the rotating base plate 164 by means of the plurality of walking/skating position slots 160. Therefore, the rotational drive of the rotating base plate 164 is transferred to the walking/skating position lock ring 158. If the user wishes to set the position of the snowboard binding 104 in the walking/skating orientation, the user needs to twist snowboard binding 104 and the rotatable assembly 108 in line with the length of the snowboard body 100A, subsequent to which the user releases the pressure applied on the foot lever 132. As soon as the foot lever 132 is de-actuated, the lock defeat slider 130 returns to its unactuated position in which the locking tabs 148 protrude beyond the at least two spaced apart tab windows 150. Once the locking tabs 148 protrude beyond the at least two spaced-apart tab windows 150, they are available to engage with either the walking/skating position lock window 162 or the riding position lock window 156. All the user needs to do after de-actuating the foot lever 132 is to rotate the binding in the desired orientation, which in this case is the walking/skating orientation until the engagement between one of the locking tabs 148 is established with the walking/skating position lock window 162 to lock the rotatable assembly 108 in the walking/skating orientation.

To adjust the snowboard binding 104 in the riding orientation, the process is the same as above, with the only difference being that the user twists the snowboard binding 104 in the riding orientation and releases the foot lever 132 to facilitate the locking of one of the locking tabs 148 into the riding position lock window 156 on the riding position lock ring 152.

Apart from setting the snowboard binding 104 in the riding orientation or the walking/skating orientation, another remaining task is to lock the hingeable movement of the hinged binding interface 174 with respect to the rotating base plate 164. This locking of the hinged binding interface 174 with respect to the rotating base plate 164 is facilitated by the main rotation post 120, the hold-down plate 122, and the cog plate 124 of the fixed assembly 106. More specifically, the hold-down plate 122 serves to hold down the rotating base plate 164 and the entire rotational assembly. The features on the periphery of the cog plate 124 serve to hold down the hinged plate 174 in all horizontal rotational angles except the walking/skating angle (close to zero). The horizontal rotational riding angles can be widely varied and remain locked down. In one embodiment, the hold-down plate may be a part of a plastic part that is fused with a lower portion of the cogged, and a system of clips is provided to lock it into the base temporarily for keeping all the parts together when the device is not bolted to a snowboard.

Figure 4:
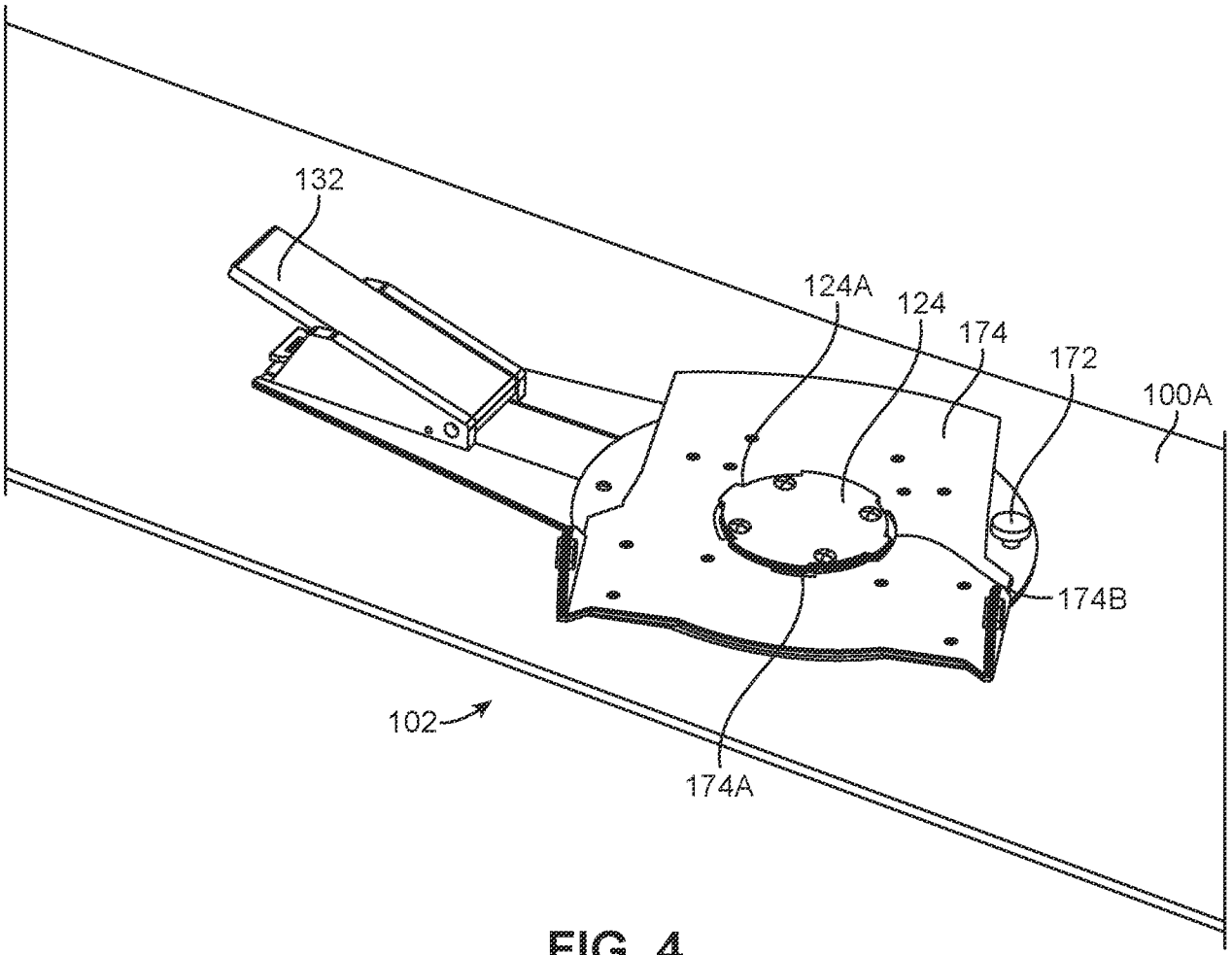
FIG. 4 shows a perspective view of the rotatable binding interface in the first orientation, according to the first embodiment of the present disclosure.

Referring to FIG. 4, a perspective view of the rotatable binding interface 102 in the riding orientation, according to the first embodiment of the present disclosure, is illustrated. As seen in FIG. 4, in the assembled state, the rotatable binding interface 102 has a substantially flat configuration. The advantageous aspect of the substantially flat configuration is attributed to the usage of substantially flat components to achieve the objective of rotating the binding in the different orientations, viz., main base, riding position lock ring, walking/skating position lock ring, and so on.

When all of the elements of the rotatable binding interface 102 are assembled on the snowboard body 100A, the cog plate 124 is the outermost part of the rotatable binding interface 102 that protrudes from the snowboard body 100A beyond the hinged binding interface 174 as well, as seen in FIG. 4. More specifically, the cog plate 124 has locking formations 124A configured on the periphery thereof. The hinged binding interface 174 also has complementary locking formations 174A configured along a periphery of the central hole 174B thereof. When the user places his foot in the binding, the hinged binding interface 174 is pressed downwards such that the cog plate 124 protrudes through the central hole 174B. The locking formations 174A are configured to be accommodated between the hold-down plate 122 and the cog plate 124. In an embodiment, the hold-down plate 122 has a slightly larger diameter than the main rotation post 120 to hold down the rotational base plate 164. When the user locks the orientation of the rotatable assembly in any of the aforementioned orientations, the locking formations 174A are configured to abut against the locking formations 124A to lock the hinged upward movement of the hinged binding interface 174 with respect to the rotating base plate 164.

Figure 5:
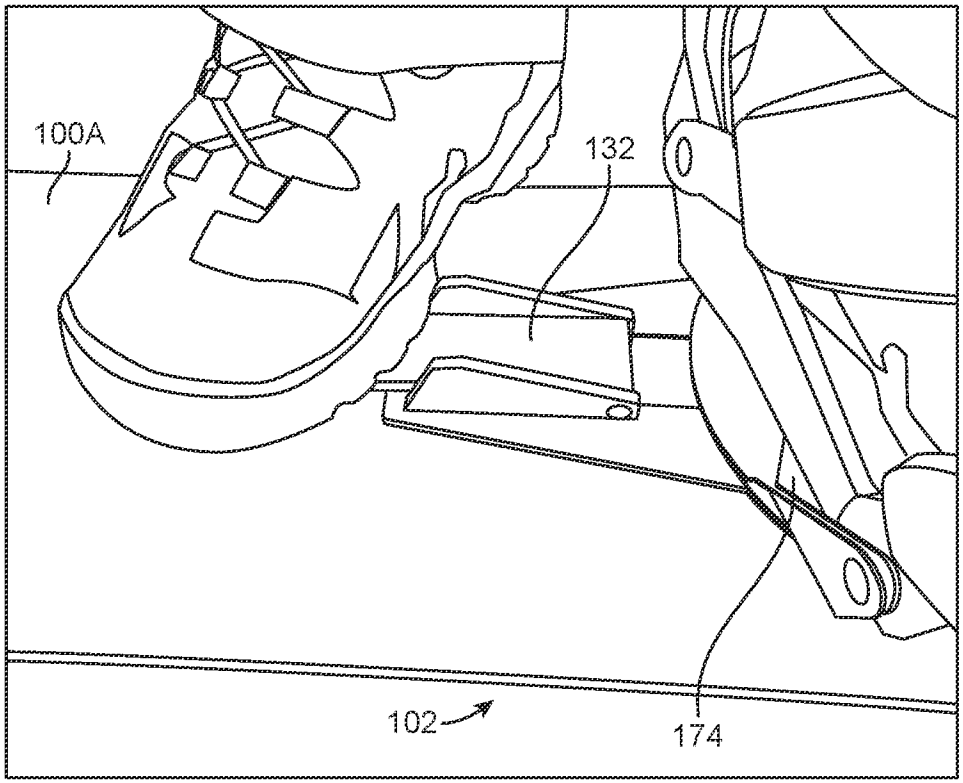
FIG. 5 shows a perspective view depicting the process to vary the orientation of the rotatable binding interface, according to the first embodiment of the present invention.
Figure 6:
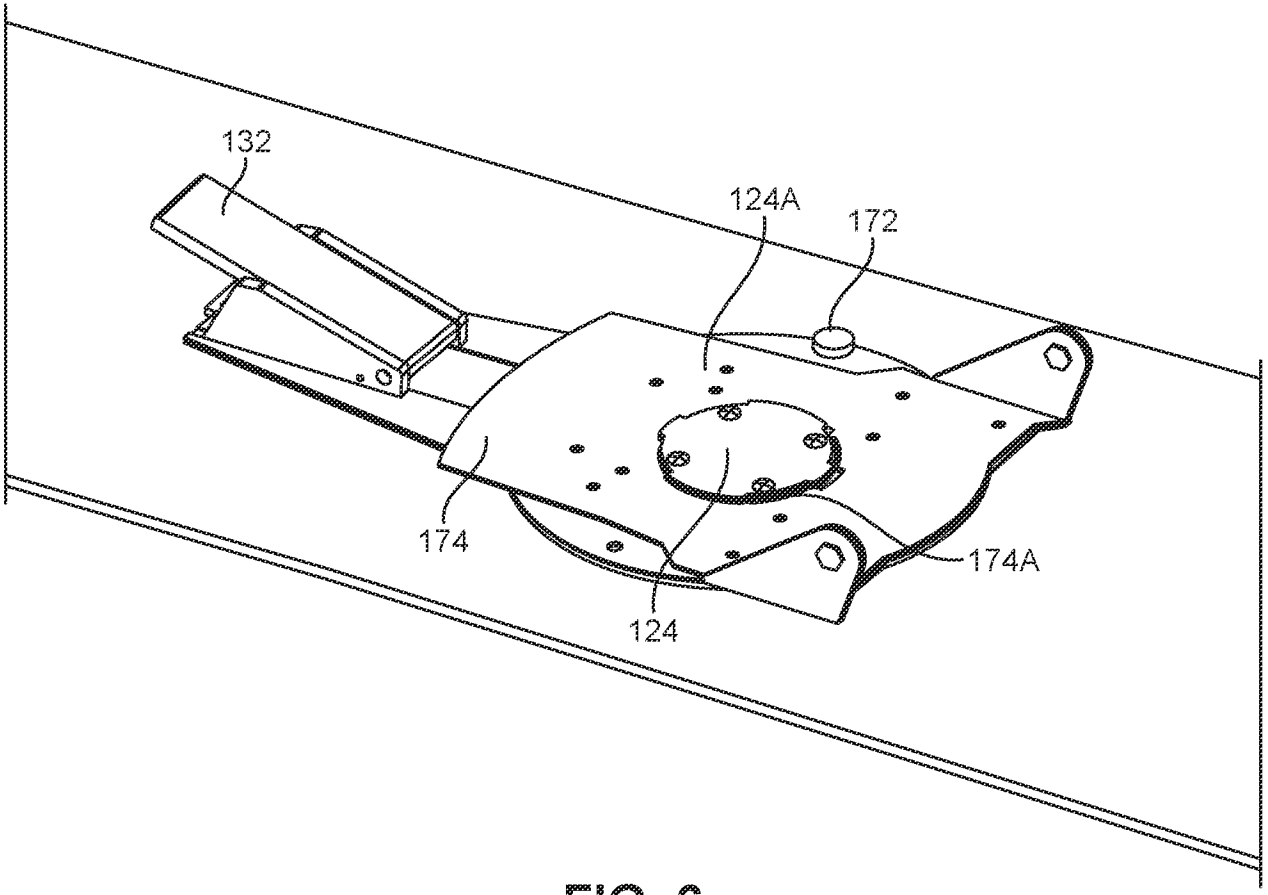
FIG. 6 shows a perspective view of the rotatable binding interface in a second orientation, according to the first embodiment of the present disclosure.
Figure 7:
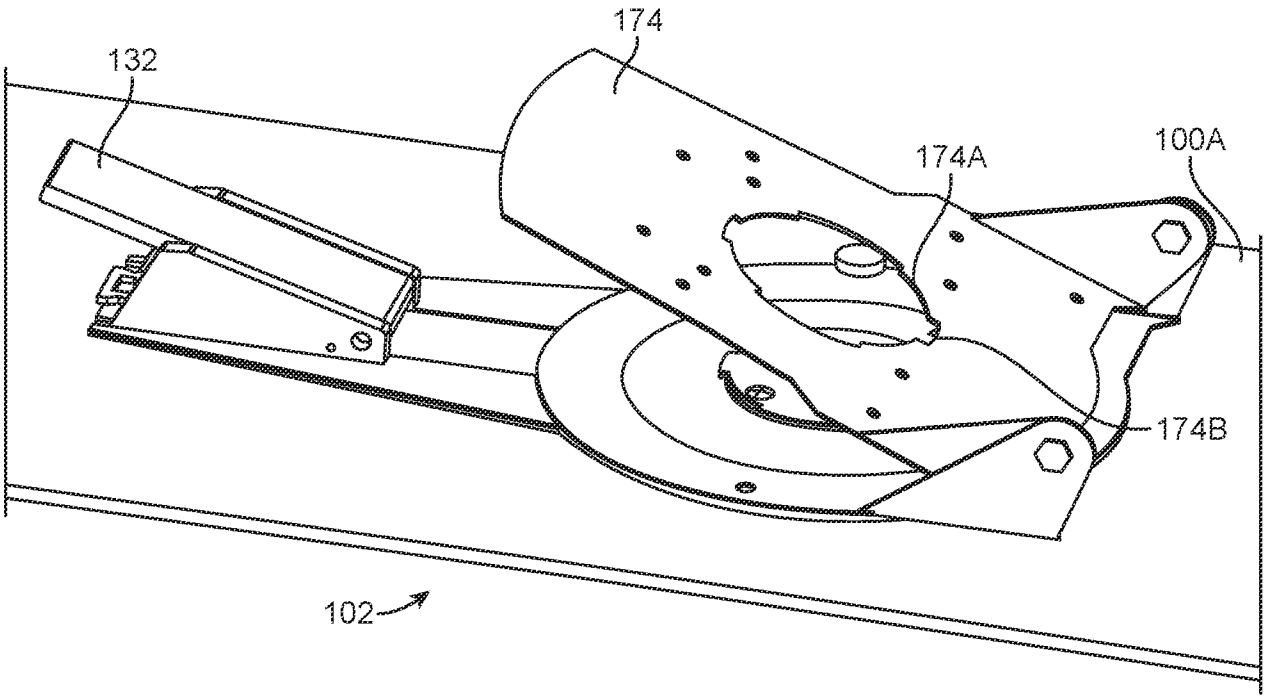
FIG. 7 shows a perspective view depicting the hingeable nature of the connection of the rotatable binding interface on the snowboard, according to the first embodiment of the present disclosure.

Referring to FIG. 5, a perspective view depicting the process to vary the orientation of the rotatable binding interface, according to the first embodiment of the present invention, is illustrated. To change the orientation, the first step is to actuate the foot lever 132. Referring to FIG. 6, a perspective view depicting an alignment of the cog plate 124 with the hinged binding interface 174, according to the first embodiment of the present disclosure, is illustrated. When the foot lever 132 is actuated, the hinged binding interface 174 may be rotated and brought into alignment with the cog plate 124 such that the locking formation 124A and 174A are aligned to facilitate the opening of the hinged binding interface 174, which can be seen in FIG. 7.

Figure 8:
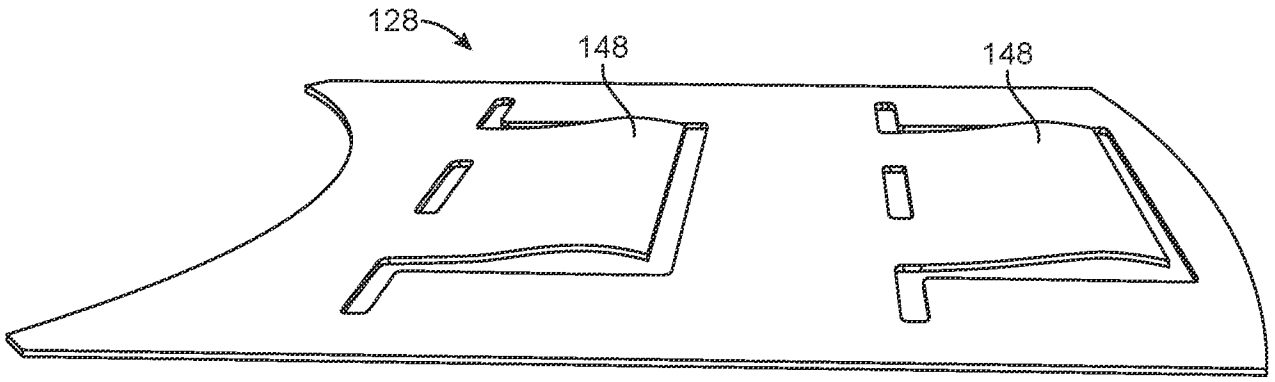
FIG. 8 shows a perspective view of the locking tab plate used in the rotatable binding interface, according to the first embodiment of the present disclosure.

Referring to FIG. 8, a perspective view of the locking tab plate 128 used in the rotatable binding interface 102, according to the first embodiment of the present disclosure, is illustrated. As seen in FIG. 8, the tabs 148 are rectangular cutouts, wherein these rectangular cutouts have a curved profile that protrudes out of the plane of the locking tab plate 128. These cutouts may be formed by the conventional cutting and punching operations, and as such are easy to manufacture. In accordance with one embodiment, the material for the locking tab plate 128 is selected to provide a resilient configuration to the locking tabs 148.

Figure 9:
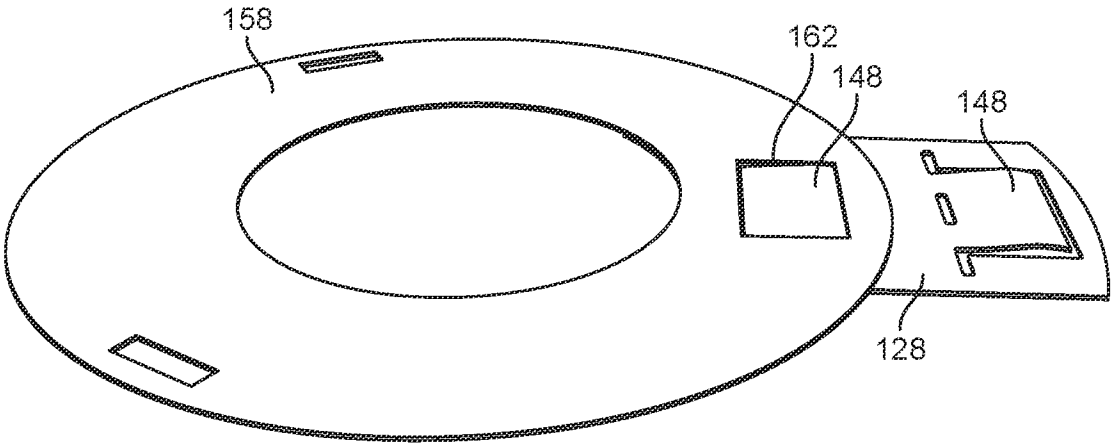
FIG. 9 shows a perspective view of a walking/skating position locking ring used in the rotatable binding interface, according to the first embodiment of the present disclosure.

Referring to FIG. 9, a perspective view of the walking/skating position lock ring 158 used in the rotatable binding interface, according to the first embodiment of the present disclosure, is illustrated. The engagement of the walking/skating position lock window 162 with the locking tab 148 can be seen in FIG. 9. It is to be noted that such an engagement provides enough stability to the rotatable binding interface of the snowboard to deal with the various loads associated with the typical operation and use of the snowboard.

Figure 10:
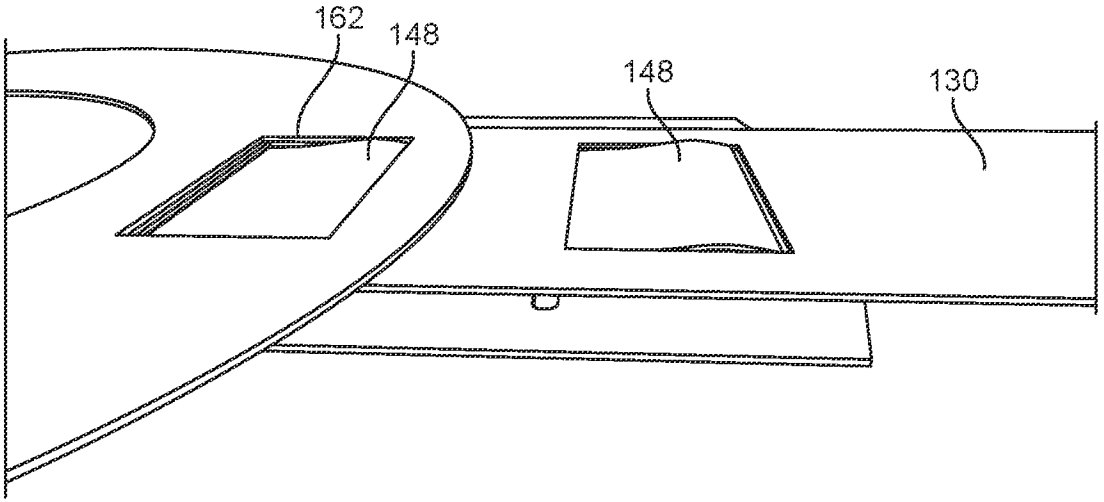
FIG. 10 and FIG. 11 show perspective views depicting the operation of a lock defeat slider used in the rotatable binding interface, according to the first embodiment of the present disclosure.
Figure 11:
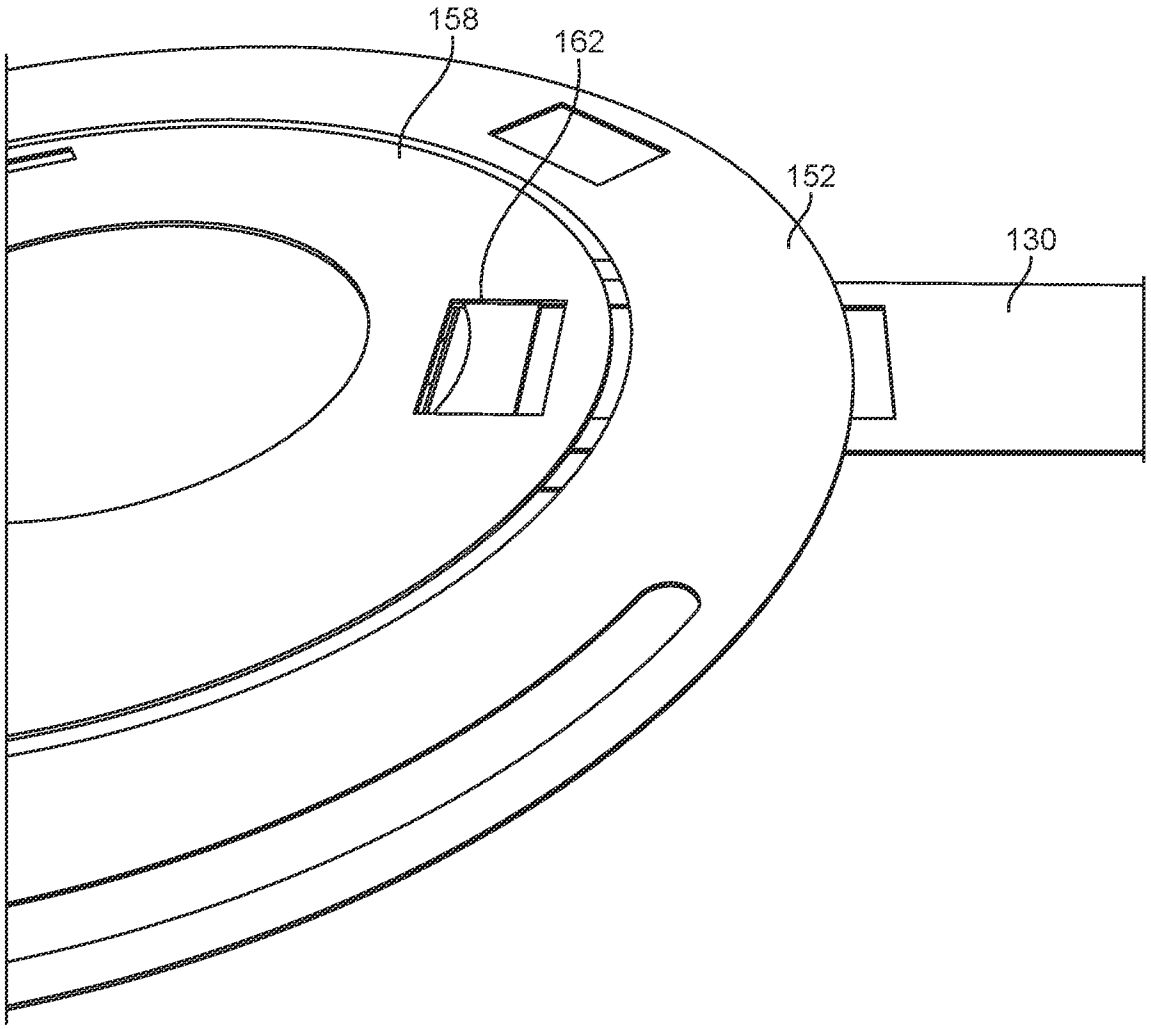

FIG. 10 and FIG. 11 show perspective views depicting the operation of a lock defeat slider 130 used in the rotatable binding interface, according to the first embodiment of the present disclosure. The engagement of the locking tab 148 with the at least two spaced-apart tab windows 150 is seen in FIG. 10, whereas the operation of the lock defeat slider 130 to disengage the locking tab 148 from the walking/skating position lock window 162 can be seen in FIG. 11.

Figure 12:
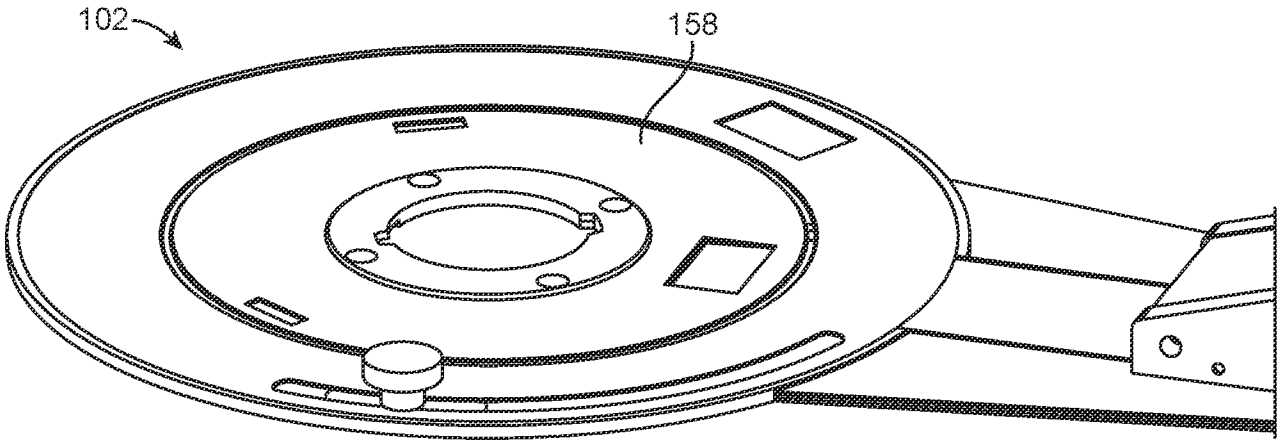
FIG. 12 and FIG. 13 show perspective views of various components of the rotatable binding interface in an assembled configuration thereof, according to another embodiment of the present disclosure.
Figure 13:
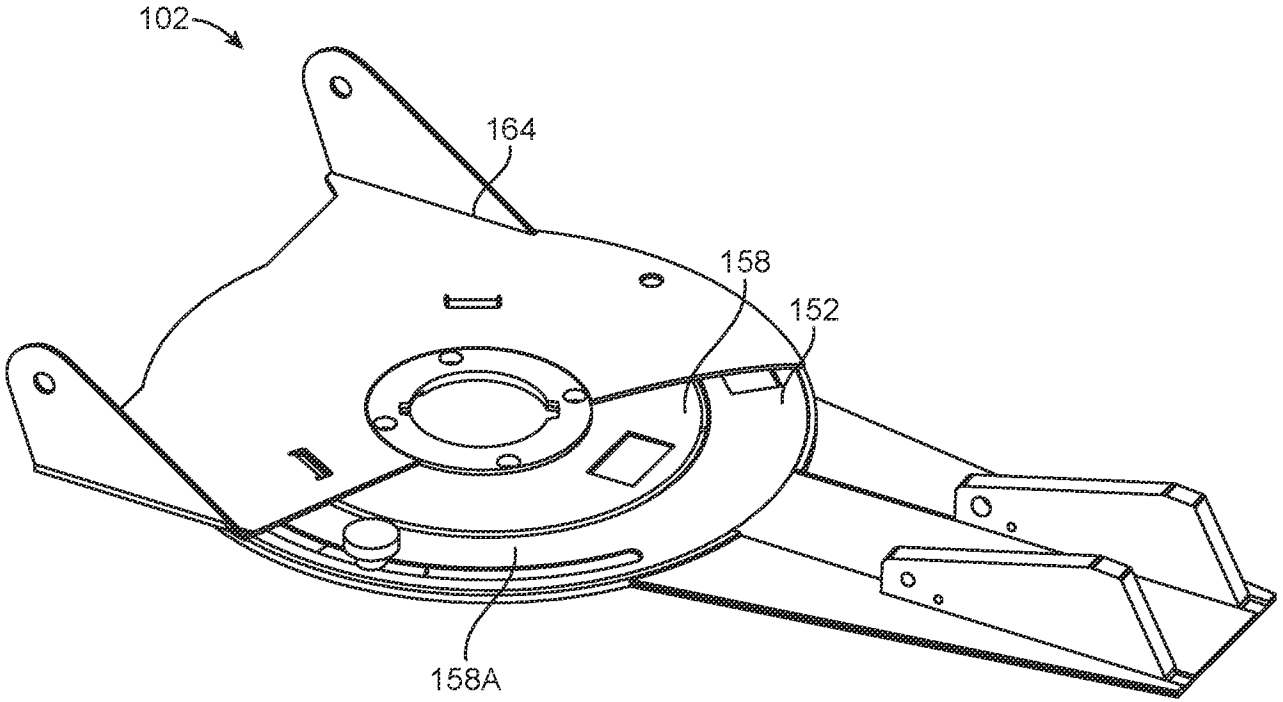

FIG. 12 and FIG. 13 show perspective views of various components of the rotatable binding interface in an assembled configuration thereof, according to another embodiment of the present disclosure. FIG. 12 and FIG. 13 depict the assembly of the rotating base plate 164 on the riding position lock ring 152 and the walking/skating position lock ring 158. One aspect of the rotatable assembly is that the walking/skating position lock ring 158 and the riding position lock ring 152 are arranged such that a first angle is formed between the walking/skating position lock window and the riding position lock window. In one embodiment, the first angle may range from about 20° to 120°. The first angle represents the difference between the angular position of the binding in the walking/skating orientation and the riding orientation.

Referring back to FIG. 4, an advantageous aspect of the rotatable binding interface 102, in accordance with an embodiment of the present disclosure, is that the angle at which riding orientation has to be set may be varied by the user. When the riding position lock ring 152 is locked into riding position, that is, one of the locking tabs 148 is locked into lock window 156, the first angle can be conveniently adjusted. When the fitment of the lock bolt 170 with the knob holding base 116 is loosened, the user may use the twisting force from their foot to adjust and vary the position of the knob holding base 116 in the first slot 114 to vary the first angle between the walking/skating position lock ring 158 and the riding position lock ring 152 to a position that they are most comfortable in while riding the snowboard. When the connection of the lock bolt 170 with the knob holding base 116 is tightened, the twisting movement of the user's foot is still transferred to the riding position lock ring 152 but this transmission of the motion does not influence the angle between the walking/skating position lock ring 158 and the riding position lock ring 152. When the connection of the lock bolt 170 with the knob holding base 116 is tightened, this connection facilitates the transmission of the twisting motion of the user's foot to the riding position lock ring 152 to adjust the position of the binding in the riding orientation. An advantageous aspect of such a feature is that the user can vary the amount of rotation required to switch between the walking and the riding orientations, thereby providing the user with several angle variations for the riding position lock ring 152 across the entire length of the second slot 154.

Another advantageous aspect of the rotatable binding interface 102 is that one can also manually flip the riding position lock ring 152 and assemble them on the main base 112. The first slot 114 extends along the periphery of the rotatable assembly receiving section 112A, as seen in FIG. 3. As such, when the riding position lock ring 152 is flipped, the second slot 154 will still coincide with the first slot 114. Furthermore, the hole for the lock bolt 170 may also be provided on both sides of the rotating base plate 164 to permit the motion transmission from both sides of the rotating base plate 164 to the riding position lock ring 152. This further increases the angle variations available to a user for different orientations of the binding, thereby accommodating all types of riders, including right-foot forward riders.

In yet another embodiment, the hinged binding interface 174 may have a detachable configuration to facilitate easy attachment and detachment thereof to the rotating base plate 164. In this case, the bottom of either the adapter plate, the binding, or the boot can be used as a tread and the snowboarder can walk around the lodge or ski area without the snowboard. The snowboarder can re-attach using the hinge as step-in and the cog plate as a hold-down lock when rotated into riding mode.

Figure 14:
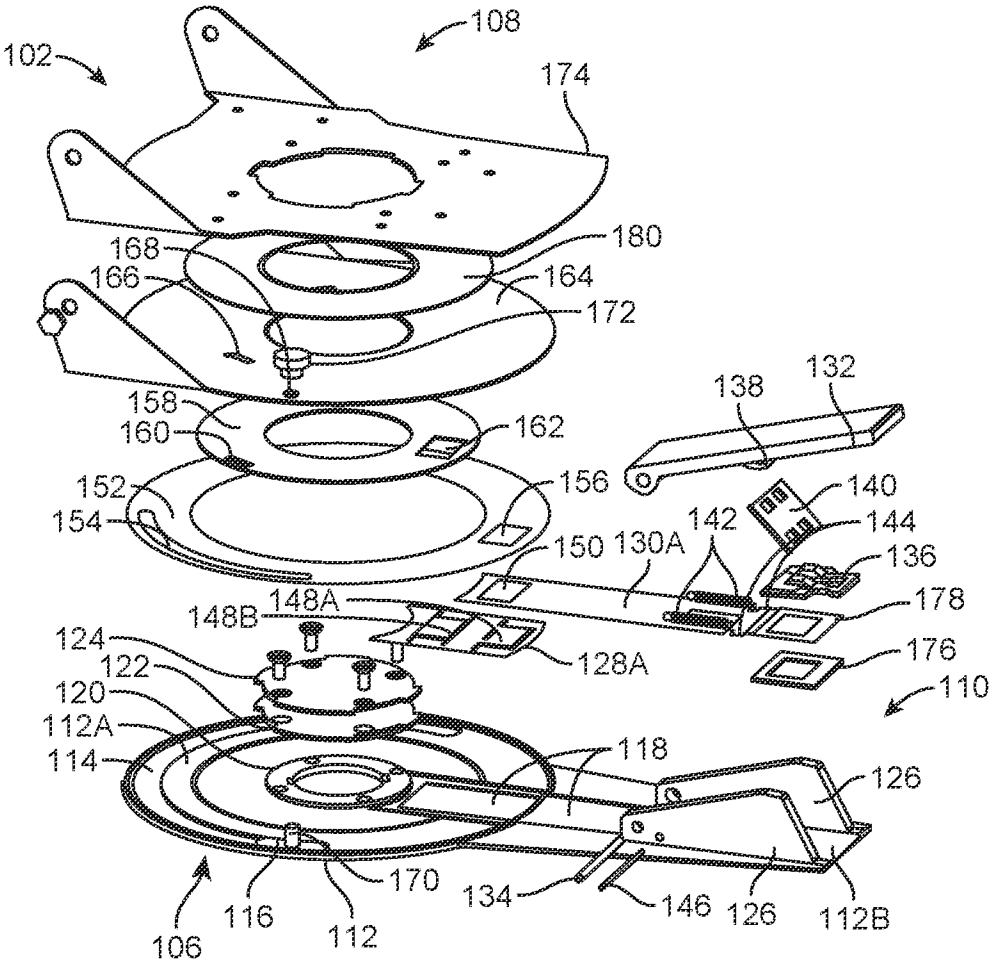
FIG. 14 shows an exploded view of the rotatable binding interface, according to a second embodiment of the present disclosure.

Referring to FIG. 14, an exploded view of the rotatable binding interface 102, according to a second embodiment of the present disclosure, is illustrated. The second embodiment of the rotatable binding interface 102 includes a modified lock plate 128A and a modified lock defeat slider 130A. Referring to FIG. 14, in the instant embodiment, the lock defeat slider 130A is shorter than lock defeat slider 130 and has only one tab window 150. The significance of such a configuration of the lock defeat slider 130A is explained in the subsequent section.

Figure 15:
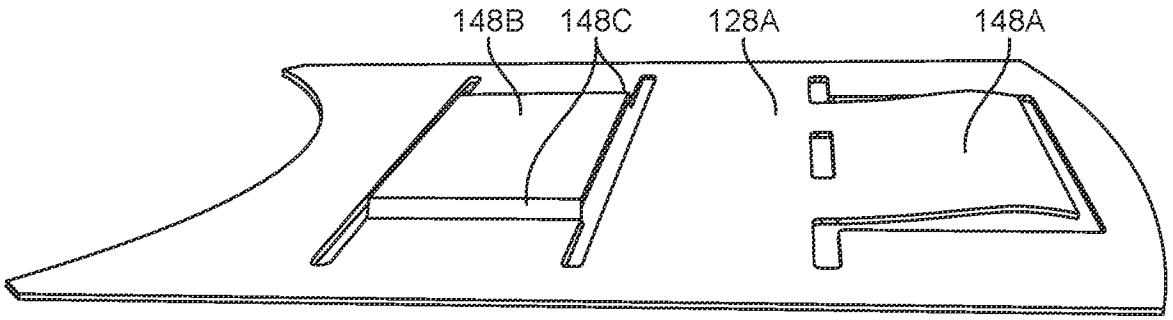
FIG. 15 shows a perspective view of the locking tab plate used in the rotatable binding interface, according to the second embodiment of the present disclosure.

Referring to FIG. 15, a perspective view of the locking tab plate 128A used in the rotatable binding interface 102, according to the second embodiment of the present disclosure, is illustrated. The locking tab plate 128A includes a first locking tab 148A and a second locking tab 148B, wherein the first locking tab 148A is identical to the locking tab 148 of the locking tab plate 128. The second locking tab 148B is a protrusion that is bent upward and has steeply angled ends 148C that fit onto the locking window 162 of the walking/skating position lock ring 158 to create resistance to the locking window in the walking/skating position lock ring 158. As mentioned previously, the lock defeat slider 130A includes only one tab window 150 to avoid interfacing with the second locking tab 148B of the locking tab plate 128A. In the instant embodiment, the lock defeat is accomplished by applying a firmer twisting force to overcome the slight locking of the second locking tab 148B.

Figure 16A:
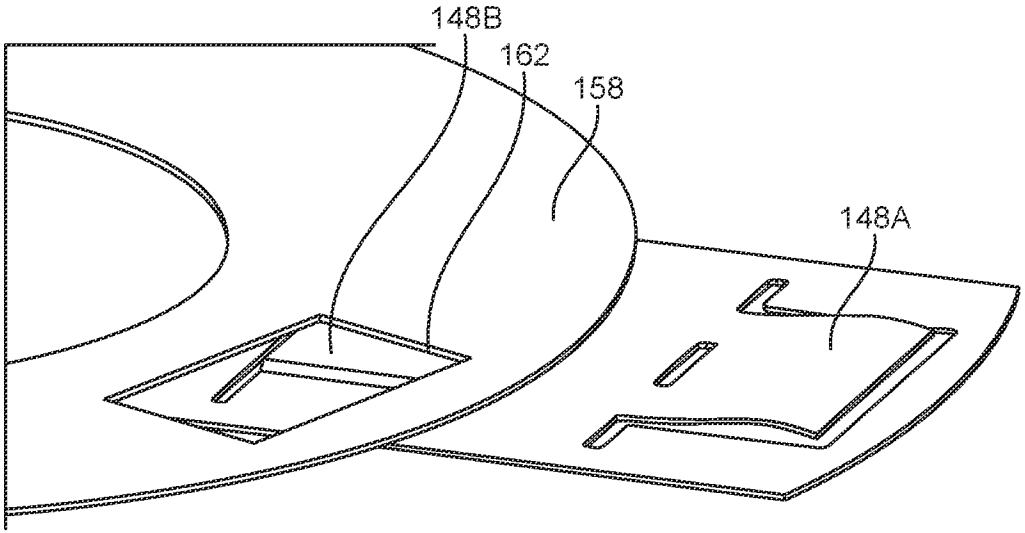
FIG. 16A thru FIG. 16C shows a perspective view of a walking/skating position locking ring used in the rotatable binding interface in various stages of engagement, according to the second embodiment of the present disclosure.
Figure 16B:
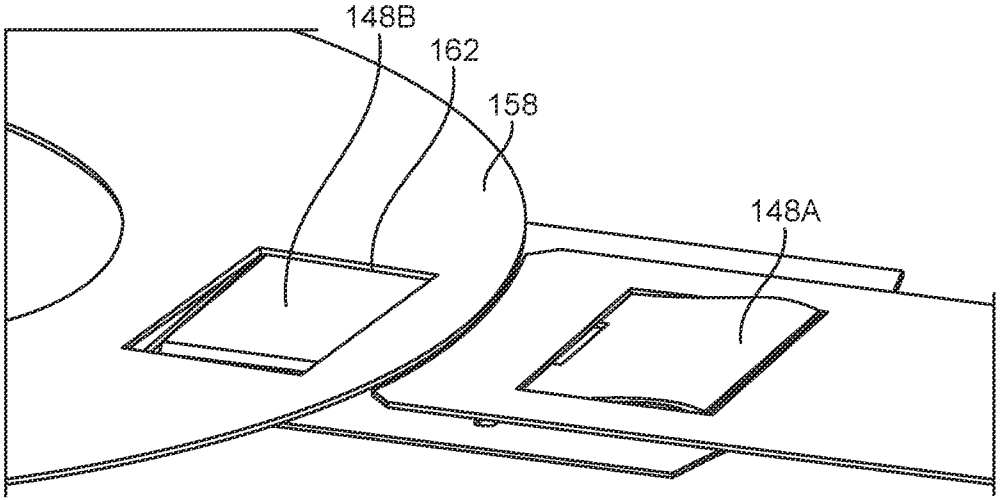
Figure 16C:
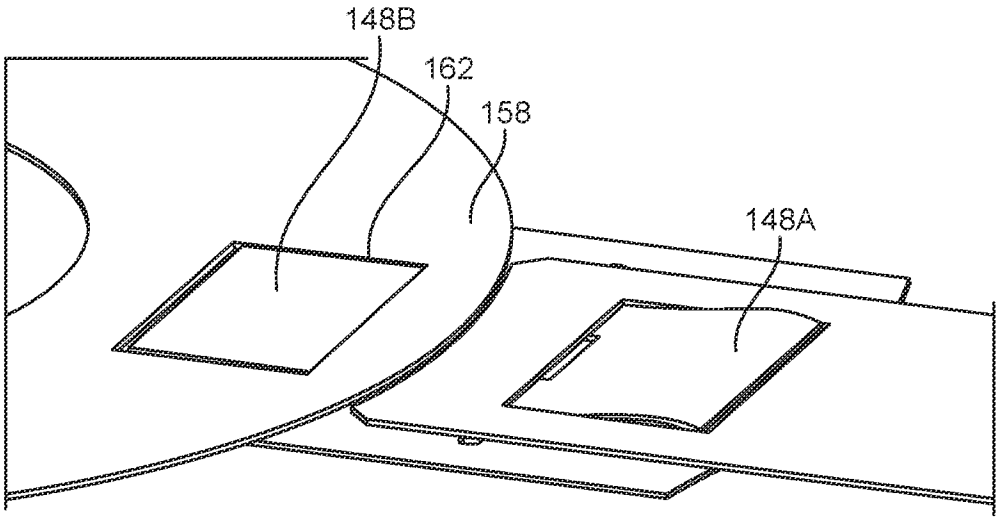

FIG. 16A thru FIG. 16C shows a perspective view of a walking/skating position locking ring used in the rotatable binding interface in various stages of engagement, according to the second embodiment of the present disclosure. More specifically, FIG. 16A thru FIG. 16C depicts the interaction of the second locking tab 148B with the locking window 162 of the walking/skating position lock ring 158 in various stages of engagement as the walking/skating position lock ring 158 is rotating.

Figure 17A:
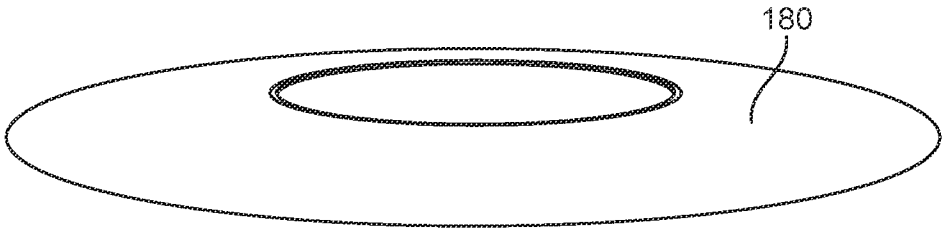
FIG. 17A shows a perspective view of an icebreaker disk used in the rotatable binding interface, according to the third embodiment of the present disclosure.
Figure 17B:
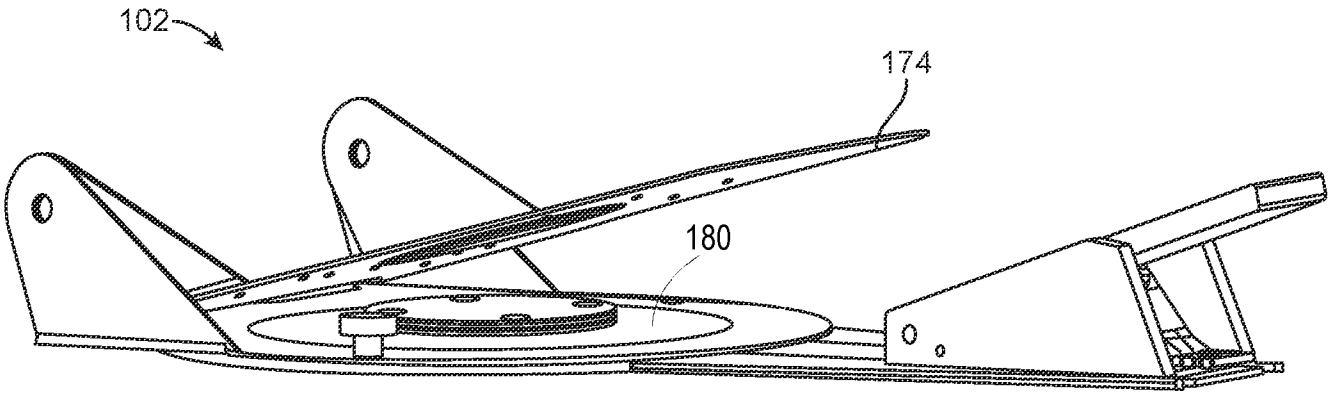
FIG. 17B shows a perspective view of the placement of the icebreaker disk on the rotatable binding interface, according to the third embodiment of the present disclosure.

FIG. 17A shows a perspective view of an icebreaker disk 180 used in the rotatable binding interface 102, according to the third embodiment of the present disclosure. FIG. 17B shows a perspective view of the placement of the icebreaker disk 180 on the rotatable binding interface 102 operatively below the hinged binding interface 174. In accordance with one embodiment, the icebreaker disk 180 has a slightly conical (convex upward) shape and a thickness of ranging from 1 mm or 2 mm at an inner opening 180A of the icebreaker disk 180, which gets thinner towards the outer rim of the icebreaker disk 180, which is about 0.2 mm. The icebreaker disk 180 forces compressed snow outward to prevent packing on the rotatable binding interface 102.

An advantageous aspect of the rotatable binding interface, in accordance with some embodiments of the present disclosure, is that the rotatable binding interface is designed with a high proportion of width to thickness to maximize the sheer strength of thin materials in lateral directions while allowing the assembly to flex in vertical directions. This is to allow the rotatable binding interface to conform to the slight curvature of the snowboard at rest and to flex with the snowboard as it flexes through the curves and bumps as it is designed to do. Another advantageous aspect of the thin materials is that the entire assembly of the rotatable binding interface is very thin and very light, which overcomes the issues many snowboarders have regarding conventional devices mounted on their snowboards, i.e., it won't raise the binding off the board too high, and the weight is less noticeable for jumping and general handling on the terrain.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A rotatable binding interface for a snowboard for facilitating usage of the snowboard in at least two different orientations, the rotatable binding interface comprising:

a fixed assembly capable of coupling to a snowboard body;

a rotatable assembly coupled to the fixed assembly, wherein the rotatable assembly is configured to allow fitment of a binding thereon; and a locking assembly securely disposed on the fixed assembly and configured to lock the rotatable assembly in at least two different orientations;

wherein the fixed assembly comprises a main base adapted to be disposed on the snowboard body, the main base including a rotatable assembly receiving section and a locking assembly receiving section; and a pair of protective walls configured on each side of the locking assembly receiving section of the main base.

2. The rotatable binding interface according to claim 1, wherein the user rotates the rotatable assembly by using a foot placed in the binding by applying a twisting motion drive to the rotatable assembly, and wherein rotatable assembly is configured to be locked to the at least two different orientations for the user.

3. The rotatable binding interface according to claim 1, wherein the at least two different orientations are predetermined orientations.

4. The rotatable binding interface according to claim 1, wherein:

a first slot is configured on the rotatable assembly receiving section for movably accommodating a knob holding base therein;

a base recess is configured on the main base for accommodating at least one component of the locking assembly therein, wherein the base recess is formed and extends on the rotatable assembly receiving section and the locking assembly receiving section;

a main rotation post securely disposed substantially centrally on the main base;

a hold-down plate is securely disposed on top of the main rotation post; and a cog plate is securely disposed on top of the hold down plate, wherein the cog plate includes locking formations formed on a periphery thereof.

5. The rotatable binding interface according to claim 4, wherein the locking assembly comprises:

a locking tab plate securely disposed in the portion of the base recess formed on the rotatable assembly receiving section of the main base;

a lock defeat slider securely held in the portion of the base recess formed on the locking assembly receiving section and configured to slide and interface with the locking tab plate for selectively facilitating locking and unlocking of the rotatable assembly in at least two different orientations; and a foot lever hinged to the protective walls via a hinge rod and coupled to the lock defeat slider for facilitating sliding movement of the lock defeat slider subsequent to the actuation of the foot lever by the user.

6. The rotatable binding interface according to claim 5, wherein the locking assembly further comprises:

a lower pushrod attachment formation configured at a distal end of the lock defeat slider;

an upper pushrod attachment formation configured at a bottom surface of the foot lever;

a push rod attachable between the lower pushrod attachment formation and the upper pushrod attachment formation; and at least one biasing member installed between a pair of spring attachment tabs extending from the lock defeat slider and a spring holder rod fitted between the pair of protective walls, the at least one biasing member is configured to facilitate the return of the lock defeat slider to an unactuated at rest position after the removal of the user's foot from the foot lever.

7. The rotatable binding interface according to claim 6, wherein the locking tab plate comprises at least two spaced-apart locking tabs, wherein the locking tab is a cutout protrusion extending from the body of the locking tab plate, and wherein the locking tab has a curved profile that protrudes up from the plane of the locking tab plate.

8. The rotatable binding interface according to claim 7, wherein the lock defeat slider includes at least one tab window configured to align with and receive therein the at least one locking tab when the lock defeat slider is in the un-actuated at rest position, wherein the lock defeat slider is configured to slide over the at least one locking tab subsequent to the actuation of the foot lever to push the at least one locking tab into the plane of locking tab plate to disable the locking of the rotatable assembly as long as the foot lever is in a pressed actuated position.

9. The rotatable binding interface according to claim 8, wherein the rotatable assembly comprises:

a riding position lock ring configured to be securely disposed on the rotatable assembly receiving section of the main base, the riding position lock ring includes a second slot configured to align with the first slot subsequent to the placement of the riding position lock ring on top of the rotatable assembly receiving section of the main base, wherein a lock bolt extends from the knob holding base for receiving a tightening knob thereon, wherein the lock bolt is configured to pass through the second slot, and wherein the knob holding base is movable along of the first slot, wherein:

the riding position lock ring includes a riding position lock window configured thereon, the riding position lock window is configured to interface with one of the at least one locking tab, wherein the locking tab is configured to fit into the riding position lock window when the riding position lock ring is rotated and the riding position lock window passes over the locking tab;

a walking/skating position lock ring disposed adjacent an inner periphery of the riding position locking ring such that the walking/skating position lock ring and the riding position lock ring are substantially coplanar, wherein:

the walking/skating position lock ring includes a walking/skating position lock window configured thereon, the walking/skating position lock window is configured to interface with one of the at least one locking tab, wherein the locking tab is configured to fit into the walking/skating position lock window when the walking/skating position lock ring is rotated and the walking/skating position lock window passes over the locking tab;

a rotating base plate securely coupled with the walking/skating position lock ring for transmitting the rotary motion drive from the rotating base plate to the walking/skating position lock ring, wherein:

the rotating base plate includes a hole for receiving the lock bolt, wherein the lock bolt extends from the knob holding base and passes through the second slot to receive the tightening knob, wherein the rotation of the rotating base plate is transferred to the riding position lock ring via the lock bolt; and a hinged binding interface hingeably coupled to the rotating base plate and configured to receive the binding thereon, wherein the twisting rotary movement of the foot is transferred from the hinged binding interface to the walking/skating position lock ring and the riding position lock ring via the rotating base plate.

10. The rotatable binding interface according to claim 9, wherein the hinged binding interface has a detachable configuration to facilitate easy attachment and detachment thereof to the rotating base plate.

11. The rotatable binding interface according to claim 9, wherein the walking/skating position lock ring and the riding position lock ring are arranged such that a first angle is formed between the walking/skating position lock window and the riding position lock window.

12. The rotatable binding interface according to claim 11, wherein the first angle ranges from about 20° to 120°.

13. The rotatable binding interface according to claim 9, wherein the riding position lock ring can be flipped over and the knob holding base and lock bolt can be positioned on the opposite side of the rotating base plate in a hole prepared therein.

14. The rotatable binding interface according to claim 4, wherein upon rotation toward a position along the length of the snowboard, when the rotation has reached an intended stopping point, the knob holding base will contact an end of the slot, halting further rotational motion at the longitudinal direction at the point the rotation is locked into a walking or a skating position.

15. A rotatable binding interface for a snowboard for facilitating usage of the snowboard in at least two different orientations, the rotatable binding interface comprising:

a fixed assembly capable of coupling to a snowboard body;

a rotatable assembly coupled to the fixed assembly, wherein the rotatable assembly is configured to allow fitment of a binding thereon;

a locking assembly securely disposed on the fixed assembly and configured to lock the rotatable assembly in at least two different orientations; and an icebreaker ring that, in use, creates a pressure imbalance upon compressing snow thereby tending to force the snow outward and away.

16. The rotatable binding interface according to claim 15, wherein the icebreaker ring has a convex upward shape.

17. A rotatable binding interface for a snowboard, comprising:

a fixed assembly capable of coupling to a snowboard body;

a rotatable assembly coupled to the fixed assembly, wherein the rotatable assembly is configured to allow fitment of a binding thereon; and a locking assembly securely disposed on the fixed assembly and configured to lock the rotatable assembly in at least two different predetermined orientations;

wherein the fixed assembly comprises a main base adapted to be disposed on the snowboard body, the main base including a rotatable assembly receiving section and a locking assembly receiving section; and a pair of protective walls configured on each side of the locking assembly receiving section of the main base.

* * * * *